US005345880A

United States Patent [19]

Shamie

[11] Patent Number: 5,345,880

[45] Date of Patent: Sep. 13, 1994

[54] TABLE HAVING A PIVOTING SUPPORT EXTENSION

[76] Inventor: Louis Shamie, 972 Dean St., Brooklyn, N.Y. 11238

[21] Appl. No.: 163,573

[22] Filed: Dec. 6, 1993

Related U.S. Application Data

[63] Continuation of Ser. No. 868,465, Apr. 14, 1992, abandoned.

[51] Int. Cl.[5] ..... A47B 57/00

[52] U.S. Cl. ..... 108/63; 312/279

[58] Field of Search ..... 312/279, 315; 108/34, 108/35, 69, 63

[56] References Cited

U.S. PATENT DOCUMENTS 3,703,324 11/1972 Smith ..... 312/279

5,142,995 9/1992 Brunner ..... 312/315

*Primary Examiner*—Kenneth J. Dorner

*Assistant Examiner*—Gerald A. Anderson

*Attorney, Agent, or Firm*—Burgess, Ryan & Wayne

[57] ABSTRACT

A table includes a main support platform having an upper surface; opposite side walls fixedly mounted on the main support platform at opposite sides thereof; a rear wall fixedly mounted on the main support platform at a rear edge thereof, with the opposite side walls and the rear wall extending to a height above the upper surface of the main support platform; a support extension platform for effectively forming an extension of the upper surface of the main support platform; opposite side walls fixedly mounted on the support extension platform; and pivot pins for pivotally connecting pivoted ends of the opposite side walls which are mounted on the support extension platform to the opposite side walls mounted on the main support platform, such that the support extension platform can be pivoted between a position in which it effectively forms an extension of the main support platform and a position in which it extends above the opposite side walls and the rear wall which are mounted on the main support platform, in spaced relation thereto.

5 Claims, 3 Drawing Sheets

TABLE HAVING A PIVOTING SUPPORT EXTENSION

This application is a continuation of application Ser. No. 868,465, filed Apr. 14, 1992 now abandoned.

BACKGROUND OF THE INVENTION

The present invention relates generally to tables, and more particularly, is directed to a table that can safely be used as a changing table for infants.

The use of infant changing tables as articles of furniture has become widespread. Changing tables, in addition to serving as supports for infants when changing soiled diapers, also generally include drawers, shelving or the like for storage of infant's clothing, diapers, changing materials, and the like. As a result, changing tables are often independent, self-supporting articles of furniture.

In many instances, the changing table will be incorporated with some other item of furniture. For example, the changing table may be secured to the end panel of a crib. This provides ease of use of the changing table, while reducing the amount of floor space that is required.

In order to further conserve floor space, many changing tables provide a pivoting support extension. Specifically, the changing table includes a main upper support platform, with two opposite side walls and a rear wall in surrounding relation thereto. This prevents the infant from falling off of the changing table. However, there is no front wall, in order to provide access to the infant by an adult.

The pivoting support extension includes an extension platform pivotally mounted to the front edge of the main upper support platform or to the front ends of the side walls. Thus, the extension platform can be pivoted between an open position adjacent to and coplanar with the main upper support platform and a closed position parallel to and spaced above the main upper support platform. In the open position, the extension platform functions as an extension of the main upper support platform for supporting the infant. In the closed position, the extension platform is out of the way so as to effectively reduce the amount of floor space.

However, in the latter closed position, the extension platform rests on the upper edges of the side walls and the rear wall. With such an arrangement, there is the possibility that an infant's fingers can get caught between the rear and/or side walls and the extension platform when the extension platform is in the closed position. This is particularly the case where the changing table is attached to an end panel of a crib. In such case, an infant standing in the crib can reach over and slightly raise the extension platform. When the infant releases the extension platform, it can crush his fingers between the extension platform and the rear and/or side walls of the changing table.

The above problem is not limited to infant changing tables. For example, in the workplace, various heavy metal working tables and the like are provided with similar arrangements. In such case, a worker can get his fingers caught in the same manner as described above.

OBJECTS AND SUMMARY OF THE INVENTION

Accordingly, it is an object of the present invention to provide a table having a pivoting support extension that overcomes the problems with the aforementioned prior art.

More particularly, it is an object of the present invention to provide a table having a pivoting support extension that is pivotable between an open position coplanar and adjacent to a main upper support platform and a closed position parallel to and above the main upper support platform.

It is another object of the present invention to provide a table having a pivoting support extension that eliminates the possibility of a person's fingers being crushed in the closed position.

In accordance with an aspect of the present invention, a table includes a main support platform having an upper surface; at least one restraining wall connected with the main support platform in surrounding relation to the main support platform, the at least one restraining wall extending to a height above the upper surface; support extension means for effectively forming an extension of the upper surface of the main support platform; and pivoting means for pivotally connected the support extension means with the at least one restraining wall such that the support extension means can be pivoted between a position in which it effectively forms an extension of the main support platform and a position in which it extends above the at least one restraining wall in spaced relation thereto.

Specifically, the at least one restraining wall includes opposite side walls connected with the main support platform at opposite sides thereof, and a rear wall connected with the main support platform at a rear edge thereof, with the opposite side walls and the rear wall extending to a height above the upper surface of the main support platform.

Further, the support extension means includes a support extension platform, and the pivoting means includes opposite side walls mounted on the support extension platform and pivot pin means for pivotally connecting pivoted ends of the opposite side walls that are mounted on the support extension platform to the opposite side walls that are mounted on the main support platform.

The opposite side walls that are mounted to the support extension platform have a height less than the side walls and the rear wall that are mounted on the main support platform, at the pivoted ends thereof. At the ends thereof opposite the pivoted ends, the opposite side walls have a height greater than the side walls and the rear wall that are mounted on the main support platform.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
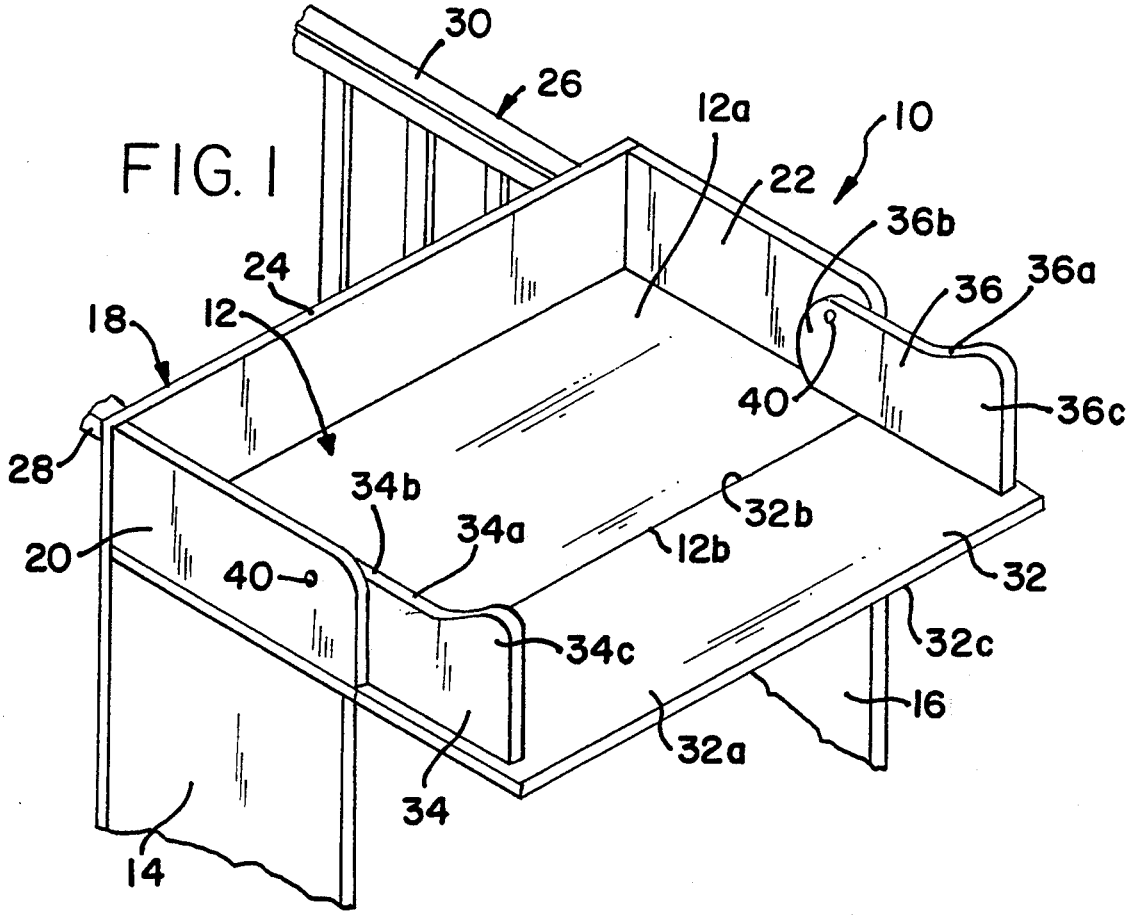
FIG. 1 is a top and front perspective view of a table having a pivoting support extension according to the present invention, showing the pivoting support extension in the open position.

Referring to the drawings in detail, a table 10 according to the present invention includes a horizontally oriented, main support platform 12 supported above ground level by side support legs 14 and 16. main support platform 12 is formed with an upper surface 12*a* and has a substantially rectangular configuration.

A restraining wall 18 is formed in partial surrounding relation to main support platform 12, and particularly, upper surface 12*a* thereof. Restraining wall 18 includes opposite vertically oriented side walls 20 and 22 fixedly mounted on upper surface 12*a* at opposite sides thereof, and a vertically oriented rear wall 24 fixedly mounted on upper surface 12*a* at the rear edge thereof, such that side walls 20 and 22 and rear wall 24 extend to a height above upper surface 12*a*. Preferably, the heights of side walls 20 and 22 and rear wall 24 are identical. Side walls 20 and 22 and rear wall 24 can be fixed in any manner to main support platform 12, for example, by screws, adhesive or the like. In this manner, the infant cannot accidently fall from the rear or side edges of main support platform 12. However, the front edge of main support platform 12 is not closed off, in order to permit easy access to the infant by an adult.

In the present embodiment, table 10 is connected with a crib 26, which is partially shown. In such case, rear wall 24 is formed by the end panel of crib 26. Also, the side rails 28 and 30 of crib 26 are partially shown. The particular mechanisms for raising and lowering side rails 28 and 30 are not shown in the drawings for the sake of simplicity and because they do not form part of the present invention.

Figure 5:
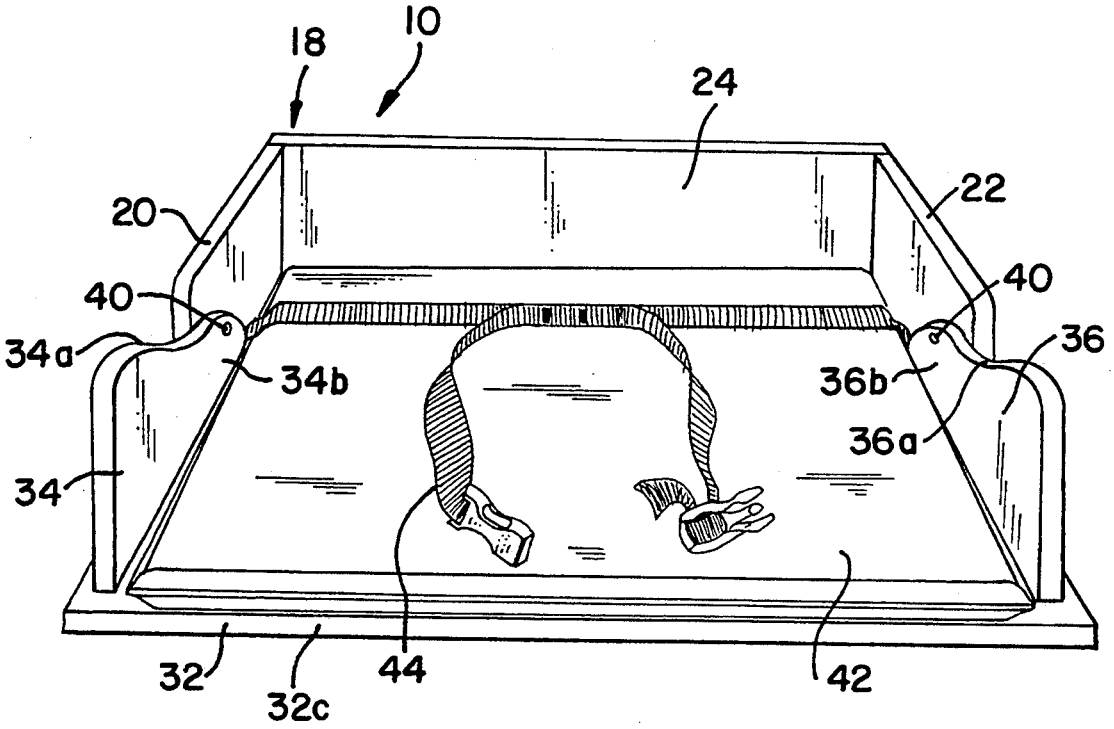
FIG. 5 is a front perspective view of the table of FIG. 1.

In accordance with the present invention, a rectangular support extension platform 32 is provided for effectively forming an extension of upper surface 12*a* of main support platform 12 at the front edge thereof 12*b*, as shown in FIGS. 1 and 5. Support extension platform 32 has a length substantially equal to the length of main support platform 12, but of a smaller width thereof.

Side walls 34 and 36 are fixedly mounted to opposite sides of upper surface 32*a* of support extension platform 32 by any suitable means, such as screws 38. As shown best in FIGS. 1, 2 and 5, side walls 34 and 36 have a configuration in which the upper surfaces 34*a* and 36*a* thereof slope upwardly from pivoted ends 34*b* and 36*b* to opposite ends 34*c* and 36*c*, respectively, of side walls 34 and 36. Specifically, the height of side walls 34 and 36 at pivoted ends 34*b* and 36*b*, respectively, is less than the height of side walls 20 and 22, while the height of side walls 34 and 36 at opposite ends 34*c* and 36*c*, respectively, is greater than the height of side walls 20 and 22.

Further, only a portion of side walls 34 and 36 are fixedly mounted on support extension platform 32 such that pivoted ends 34*b* and 36*b* thereof extend out from support extension platform 32. The distance between the outer surfaces of side walls 34 and 36 is slightly less than the distance between the inner surfaces of side walls 20 and 22. Therefore, side walls 34 and 36 fit between side walls 20 and 22. In such case, pivoted ends 34*b* and 36*b* of side walls 34 and 36 are pivotally connected, near the upper edges thereof, to side walls 20 and 22, by pivot pins 40.

Further, opposite ends 34*c* and 36*c* of side walls 34 and 36 are spaced from the front edge 32*c* of support extension platform 32.

With such pivoted relation, support extension platform 32 can be pivoted to an open position in which upper surface 32*a* thereof effectively forms an extension of and is coplanar with upper surface 12*a* of main support platform. In such open position, front edge 12*b* of main support platform 12 is in abutting contact with rear edge 32*b* of support extension platform 32, as shown in FIGS. 1 and 5.

Figure 2:
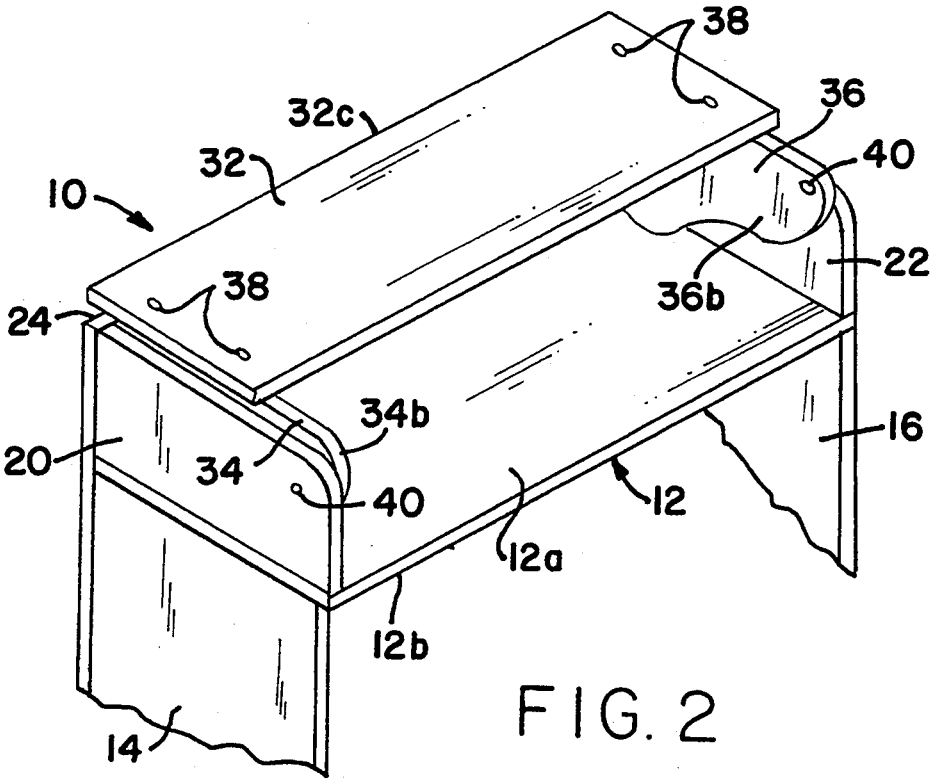
FIG. 2 is a top and front perspective view of the table of FIG. 1, showing the pivoting support extension in the closed position.
Figure 3:
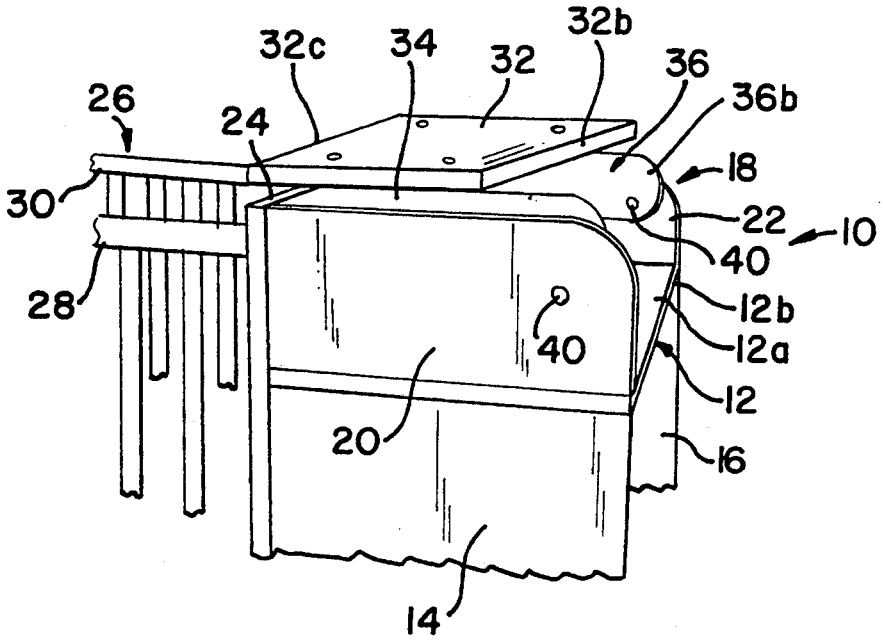
FIG. 3 is a side and top perspective view of the table of FIG. 2.
Figure 4:
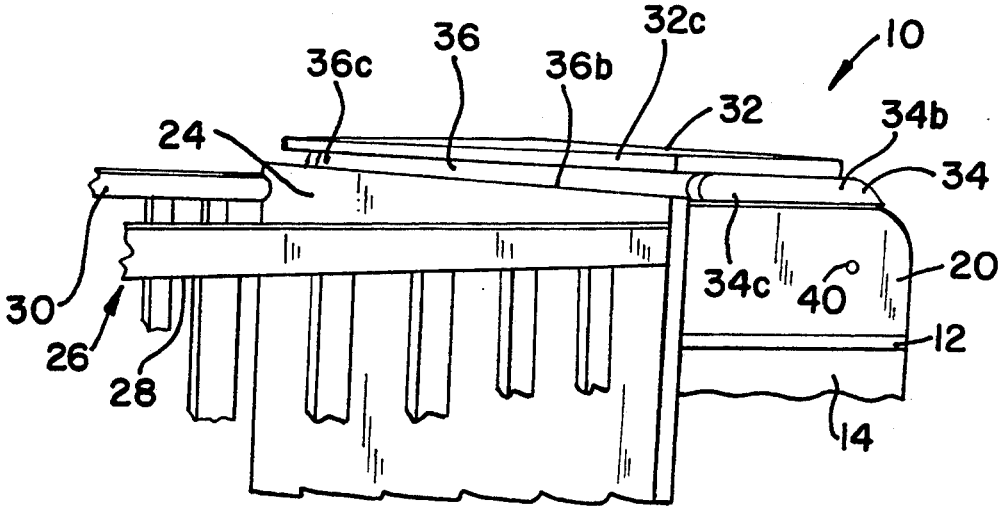
FIG. 4 is a side and rear perspective view of the table of FIG. 2.

In accordance with an important aspect of the present invention, support extension platform 32 can be pivoted 180° about pivot pins 40 to the closed position shown in FIGS. 2–4. In this position, upper surfaces 34*a* and 36*a* are inverted and opposite ends 34*c* and 36*c* thereof sit upon upper surface 12*a* of main support platform 12. Because the heights of side walls 34 and 36 at opposite ends 34*c* and 36*c* thereof are greater than the heights of the respective side walls 20 and 22 and the rear wall 24, side walls 34 and 36 at opposite ends 34*c* and 36*c* thereof extend to a height above side walls 20 and 22 and above rear wall 24, and in spaced relation thereto. As a result, support extension platform 32 does not rest upon side walls 20 and 22, or rear wall 24, but is spaced therefrom. Therefore, an infant's fingers cannot be crushed therebetween. For example, the spacing between support extension platform 32 and side walls 20 and 22 and rear wall 24 can be approximately two inches.

FIG. 5 shows an arrangement in which a padded mat 42 is positioned on upper surfaces 12*a* and 32*a*, and contains a safety strap 44 therearound for holding an infant securely thereon.

It will be appreciated that, while the present invention has been discussed with respect to an infant changing table, the invention is not limited thereby. Thus, for example, the present invention can be used in the workplace with, for example, heavy metal working tables and the like.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A table comprising:

a main support platform having an upper surface;

at least one restraining wall connected with said main support platform in surrounding relation to said main support platform, said at least one restraining wall extending to a height above said upper surface and being formed by a rear wall having an upper surface and opposite side walls with a spacing therebetween, each side wall having an upper surface;

support extension means for effectively forming an extension of said upper surface of said main support platform, said support extension means including:

a support extension platform which forms an extension of said upper surface of said main support platform in an open position, and opposite side walls mounted on said support extension platform, with a spacing between said opposite side walls of said support extension means being less than the spacing between said side walls of said at least one restraining wall, said opposite side walls of said support extension means each having a portion with a height greater than a maximum height of said side walls and said rear wall of said at least one restraining wall above said main support platform and with said portion resting upon said upper surface of said main support platform in a closed position so as to support said support extension platform above the upper surfaces of said rear wall and at least rear portions of said side walls of said at least one restraining wall in spaced relation thereto; and pivoting means for pivotally connecting said opposite side walls of said support extension means with said side walls of said at least one restraining wall such that said support extension means can be pivoted between said open position in which said support extension platform effectively forms an extension of said main support platform and said closed position in which said support extension platform extends above the upper surfaces of said rear wall and at least rear portions of said side walls of said at least one restraining wall in spaced relation thereto.

2. A table according to claim 1, wherein said main support platform has a substantially rectangular configuration.

3. A table according to claim 1, wherein said pivoting means includes pivot pin means for pivotally connecting pivoted ends of said opposite side walls of said support extension means to said side walls of said at least one restraining wall.

4. A table according to claim 3, wherein said portions of said opposite side walls of said support extension means have a height greater than that of said side walls and said rear wall of said at least one restraining wall at ends thereof opposite said pivoted ends.

5. A table according to claim 3, wherein said portions of said opposite side walls of said support extension means have a height less than said side walls of said at least one restraining wall at said pivoted ends thereof.

* * * * *